US006049344A

United States Patent [19]

Verlinden et al.

[11] Patent Number: 6,049,344

[45] Date of Patent: Apr. 11, 2000

[54] APPARATUS FOR THE WET PROCESSING OF PHOTOGRAPHIC SHEET MATERIAL

[75] Inventors: Bartholomeus Verlinden, Tongeren; Patrick Van den Bergen, Hove; Bart Verhoest, Wilrijk; Dirk de Ruÿter, Deurne; Ludo Van Schepdael, Gingelgom, all of Belgium

[73] Assignee: Agfa-Gevaert N.V., Mortsel, Belgium

[21] Appl. No.: 09/090,759

[22] Filed: Jun. 4, 1998

[30] Foreign Application Priority Data

Jun. 12, 1997 [EP] European Pat. Off. ..... 97201814

[51] Int. Cl.[7] ..... G03D 3/02; G03D 13/04

[52] U.S. Cl. ..... 346/612; 396/636

[58] Field of Search ..... 396/612, 617, 396/620, 636; 118/718; 134/64 P, 122 P

[56] References Cited

U.S. PATENT DOCUMENTS

| | | | |
|---|---|---|---|
| 3,057,282 | 10/1962 | Luboshez | 396/636 |
| 4,166,688 | 9/1979 | Sachs | 396/617 |
| 5,182,593 | 1/1993 | Fischer | 396/622 |
| 5,314,539 | 5/1994 | Brown et al. | 118/718 |
| 5,754,914 | 5/1998 | Van Den Bergen et al. | 396/612 |

FOREIGN PATENT DOCUMENTS

| | | |
|---|---|---|
| 0348869 | of 0000 | European Pat. Off. . |
| 0774691 | of 0000 | European Pat. Off. . |

*Primary Examiner*—D. Rutledge
*Attorney, Agent, or Firm*—Baker Botts L.L.P.

[57] ABSTRACT

The apparatus comprises at least one treatment vessel (12) comprising a housing (14) having a sheet material inlet opening (17) and a sheet material outlet opening (18) defining a sheet material path (20) through said vessel (12). Each opening (17, 18) is closed by a path-defining rotatable roller (28) biased towards a reaction surface (30) to form a nip (36) there-between through which said sheet material path (20) extends. The path-defining roller (28) is in contact along its length, with a plurality of rotatable intermediate rollers (38) carried in fixed bearings (40) mounted on said housing (14).

22 Claims, 3 Drawing Sheets

APPARATUS FOR THE WET PROCESSING OF PHOTOGRAPHIC SHEET MATERIAL

DESCRIPTION

1. Field of the Invention

The present invention relates to an apparatus for the wet processing of photographic sheet material, such as X-ray film, pre-sensitised plates, graphic art film and paper, and offset plates. More particularly the invention relates to improvements in apparatus in which photographic material is transported through one or more treatment vessels.

2. Background of the Invention

As a rule, a processing apparatus for photographic sheet material comprises several vessels each of which contains a treatment liquid, such as a developer, a fixer and a rinse liquid. As used herein, the term sheet material includes not only photographic material in the form of cut sheets, but also in the form of a web unwound from a roll. The sheet material to be processed is transported through these vessels in turn, by transport means such as one or more pairs of drive rollers, and thereafter optionally to a drying unit. The time spent by the sheet material in each vessel is determined by the transport speed and the dimensions of the vessel in the sheet feed path direction.

U.S. Pat. No. 4166689 (Schausberger et al. assigned to Agfa-Gevaert AG) describes an apparatus for the wet processing of photographic sheet material comprising at least one treatment vessel including a housing having a sheet material inlet opening and a sheet material outlet opening defining a sheet material path through the vessel. Each opening is closed by a pair of rollers biased towards each other to form a nip there-between through which the sheet material path extends. The roller pair also serve to transport the sheet material along the sheet material path. In such an apparatus treatment liquid escapes from the lower opening and is intercepted by the tank of a sealing device with two squeegees located in the tank above a horizontal passage in line with the lower opening.

This arrangement suffers from the disadvantage that the cell is open to the atmosphere. This means that the liquid may become oxidised, carbonised or may evaporate. Another disadvantage of this concept is the construction of the rollers. To prevent leakage of liquid via the sheet material, the rollers need a certain geometry in which the stiffness of the core and the thickness of the elastomeric material are critical. This results in a minimum diameter for the rollers and, depending upon the width of the processor, to potentially heavy weight rollers.

OBJECTS OF THE INVENTION

It is an object of the present invention to provide an apparatus for the wet processing of photographic sheet material in which the stiffness of the rollers, in order to achieve optimum transport and squeegee characteristics, is not critically dependant merely on the shape of the material and the geometry.

SUMMARY OF THE INVENTION

We have discovered that this objective and other useful benefits can be achieved when the path-defining roller is in contact along its length, with a plurality of rotatable intermediate rollers carried in fixed bearing mounted on the housing.

Thus, according to the invention there is provided an apparatus for the wet processing of photographic sheet material comprising at least one treatment vessel comprising a housing having a sheet material inlet opening and a sheet material outlet opening defining a sheet material path through the vessel, each opening being closed by a path-defining rotatable roller biased towards a reaction surface to form a nip there-between through which the sheet material path extends, characterised in that the path-defining roller is in contact along its length, with a plurality of rotatable intermediate rollers carried in fixed bearing mounted on the housing.

In order to achieve optimum transport and squeegee characteristics, the stiffness of the rollers is not critically dependant merely on the shape of the material and the geometry. This is achieved, according to the invention, by arranging that the stiffness of the roller pair is not simply dependant upon the stiffness of the individual rollers themselves, but also depends upon the mounting of the rollers in the housing.

The reaction surface towards which the path-defining roller is biased to define the nip will usually be the surface of another path-defining roller, or the reaction surface may be in the form of a belt or a fixed surface with a low friction coefficient. Where this general description refers to the use of two path-defining rollers, it is to be understood that the second path-defining roller may be replaced by any other reaction surface, such as those referred to above.

The apparatus may further comprise sealing means for sealing the path-defining roller to the housing. The sealing means is preferably constituted by the intermediate rollers, which thereby constitute sealing rollers. Alternatively, the sealing means is constituted by a stationary sealing member carried by the housing and in contact with the surface of the path-defining roller. However, by the use of sealing rollers in place of a stationary sealing member, the torque which needs to be applied to the path-defining roller can be significantly reduced. This reduces the power needed by the processor, reduces wear on the path-defining roller, reduces the mechanical deformation thereof and thereby extends the expected life time. This construction also improves the control of pressure distribution over the sheet material.

The intermediate roller preferably has a diameter less than that of the path-defining roller. For example, the intermediate rollers may have a diameter which is from one tenth to one third of the diameter of the path-defining roller, thereby enabling the torque which needs to be applied to be further reduced. The intermediate rollers preferably extends in a straight line parallel to the associated path-defining roller axis.

The intermediate roller is preferably formed of a material having a coefficient of friction, as measured against stainless steel, of less than 0.3, preferably from 0.05 to 0.2, for example highly polished metals such as steel, especially Cr-Ni steel and Cr-Ni-Mo steel, a metal coated with Ni-PTFE (NIFLOR - Trade Mark), a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof.

We prefer that each intermediate roller contacts the surface of the path-defining roller at a location which is between 45° and 315°, most preferably between 160° and 200° from the centre of the nip. Alternatively, the intermediate rollers contact the surface of the path-defining roller at an average location which is between 45° and 315°, most preferably between 160° and 200° from the centre of the nip.

In a preferred embodiment, each intermediate roller is carried by a longitudinal bearing, secured within the vessel. The longitudinal bearing may have face-to-face contact with the intermediate roller over at least two contact regions, which are located, for example, at from ±120° to 150° relative to the line joining the centres of a path-defining roller and its associated intermediate rollers, such as ±135° to that line. The width of contact between an intermediate roller and its associated longitudinal bearing in each contact region is, for example, from 20° to 40° of the circumference of the intermediate rollers, which in the case of intermediate rollers having a diameter of 8 mm may be about 2 mm per contact region.

The surface of each intermediate roller opposite to the path-defining roller may be in contact with one or more fixed sealing members carried in, or formed as part of, the longitudinal bearing. The fixed sealing member may, for example, be retained within a longitudinal groove formed in the longitudinal bearing. The fixed sealing member may have a symmetrical profile section but a non-symmetrical profile section is also possible, its shape and resilience taking into account the hydrostatic and hydrodynamic pressures in the vessel and the interacting forces with the intermediate rollers, allowing for the fact that the path-defining roller and the intermediate rollers may be adapted to rotate in both directions.

The ends of the intermediate rollers may be in contact in a leak-free manner with stationary bodies, such as an end plate secured to, or located in a fixed position relative to, the housing of the apparatus. For example, the end of the intermediate roller passes into a blind aperture in the end plate. In an alternative embodiment, the end of each intermediate roller is located in an open aperture in the end plate, this aperture being provided with a sealing ring, or other sealing member, formed for example of sintered PTFE, to prevent leakage therethrough. It is important that the intermediate rollers are retained in these end plates in a leak-free manner. A line contact between the intermediate rollers and the end plates is preferred to a surface-to-surface contact. In one embodiment, the sealing ring surrounds the end of the intermediate rollers and is urged into line-to-surface sealing engagement with the surface of the intermediate rollers by a spring. We have found that line contact between the intermediate rollers and the end plates need not extend circumferentially completely around the intermediate rollers, and indeed there is an advantage in this line contact extending only part way around the intermediate rollers, but on the liquid side thereof. This construction makes the tolerances to which the intermediate rollers and the end plates are constructed less critical. It is preferred to use a sealing ring which is so constructed as to compensate for the wear thereof. This can be achieved by forming the sealing ring with a frusto-conical inner surface and by the provision of a spring force which acts in a direction to feed sealing material towards the wear surface. We prefer to use a material for the sealing ring which has good "creeping" characteristics to compensate for the wear under spring pressure, such as sintered PTFE.

The path-defining roller may comprise a core carrying an elastomeric material covering, although it is possible for the path-defining roller to be elastomeric throughout its cross-section. By the term "core" we mean an axially inner member, which is usually cylindrical and which is relatively rigid compared to the elastomeric material covering. Suitable materials for the rigid core include metals, such as stainless steel, non-ferrous alloys, titanium, aluminium or a composite thereof. In one embodiment of the invention, the core is hollow. Alternatively the core may be solid. Usually, drive to the roller will be applied to the core. In a preferred embodiment of the invention, each of the ends of the elastomeric material covering are in sealing contact with a surface of the end plates. The surface of each end plate may be formed of, or coated with, a low friction material such as polished metal, or polytetrafluoroethylene. The elastomeric material may extend beyond the ends of the core, the sealing means being in contact with the end faces of the covering. The extension of the covering beyond the end of the core defines a space into which the elastomeric material of the covering may be deformed as a result of a sealing force between the covering and the end plate. Such an arrangement improves the sealing between the path-defining roller and the end plate.

As the sheet material leaves a given liquid treatment vessel it is necessary to remove any liquid carried on the sheet material as efficiently as possible, to reduce edge effects which arise from non-homogeneous chemistry on the sheet material after squeegeeing. To do this job properly, the path-defining rollers must exert a sufficient and homogeneous pressure over the whole width of the sheet material. Also, to reduce edge effects, it is desirable that the opposite path-defining roller surfaces are in contact with each other beyond the edges of the sheet material. To put this problem in context, path-defining rollers used in conventional processing apparatus for example having a length of 400 mm to 2000 mm or more and a diameter of from 20 to 60 mm. The sheet material typically has a width of from a few millimeters up to 2 m and a thickness of 0.05 mm to 0.5 mm. In view of the nature of elastomeric material, it is in fact impossible to totally eliminate any gap between the path-defining roller surfaces at the edges of the sheet material as it passes through the nip. It is desirable that the path-defining roller surfaces be in contact with each other within as short a distance as possible from the edges of the sheet material i.e. that the size of the leak zone should be minimised. It is important however that the force between the path-defining rollers is sufficient to prevent leakage when no sheet material is passing through. However, the force must not be so high as to risk physical damage to the sheet material as it passes through the nip.

The objective of a minimum leak zone referred to above can be achieved if the ratio of the diameter of the path-defining roller to its length is above a critical limit.

To enable this objective to be achieved, the ratio of the diameter of the path-defining roller to its length should be above a critical limit. In particular, at least one of the path-defining rollers, and preferably each path-defining roller, comprises a rigid core carrying a covering of elastomeric material, the ratio ($\phi$/L) of the maximum diameter ($\phi$) of the elastomeric material covering to the length (L) thereof being at least 0.012, most preferably between 0.03 and 0.06. Preferably both path-defining rollers conform to this requirement, although it is possible that the diameters ($\phi$), and therefore the ratios ($\phi$/L), of the two path-defining rollers need not be identical.

In one embodiment of the invention, the diameter ($\phi$) of the elastomeric material covering is constant along the length of the path-defining roller. Alternatively the path-defining roller may have a radial dimension profile which varies along the length thereof. In the latter case, the diameter ($\phi$) in the expression $\phi$/L is the maximum diameter. Alternatively or additionally, the diameter of the core varies along the length thereof. Ideally, the radial dimension profile of such a path-defining roller is such in relation to the force applied by the path-defining roller to sheet material passing through the nip as to be substantially even over the width thereof.

The elastomeric covering may comprise an inner layer of elastomeric material having a relatively low hardness, and an outer region of elastomeric material having a relatively high hardness positioned over the inner layer. Such a roller minimises carry-over between vessels without damage to the sheet material while being capable of successfully being used as a drive roller. Such a path-defining roller exhibits good stability against treatment liquids and has good processing qualities. The outer region of the elastomeric covering may be doped with a surface modifying material.

The elastomeric material covering preferably has a thickness of between 1 mm and 30 mm. The elastomeric material may be selected from ethylene/propylene/diene terpolymers (EPDM), silicone rubber, polyurethane, thermoplastic rubber such as Santoprene (Trade Mark for polypropylene/EPDM rubber), styrene-butyl rubber, nitrile-butyl rubber, PFA and Fluor-Latex (FLC) materials. The hardness of the elastomeric material may be between 15 Shore (A) and 90 Shore (A), as measured on the roller surface. Where the elastomeric material comprises an inner layer of relatively low hardness and an outer layer of relatively high hardness, the inner layer should have a hardness of less than 50 Shore A, while the outer layer should have a hardness of more than 25 Shore A.

It is a preferred feature of the present invention that the end faces of one path-defining roller lie in substantially the same planes as the end faces of the other path-defining roller. By the term "end face" we mean the face at the end of the roller, adjacent the outer surface thereof. Thus, where the roller comprises a core provided with an elastomeric material, the term "end face" as used herein means the end face of the elastomeric material covering. In this embodiment, an end face of one roller lies in exactly the same plane as an end face of the other roller, or in such a closely adjacent plane that an effective seal can be made between the end faces and the end plate or other stationary body fixed to the housing of the apparatus, taking into account any resilience in the material of which the roller and the end plate may be formed. As a consequence of this requirement, the elastomeric part of the path-defining rollers are substantially equal in length.

The end plates are preferably biased against the end faces of the path-defining rollers with a force of from 2 to 500 g/cm of contact between the end plate and the end face of the roller, measured on the surface of the roller. The pressure between the end face of the path-defining roller and the end plate should be at least $\rho*g*h$, where $\rho$ is the density of the treatment liquid (typically up to 1200 kg/m$^3$, g is 9.8 m/s$^2$ and h is the height of the treatment liquid above the sealing point. We prefer that the pressure between the end face of the path-defining roller and the end plate should be at least $2\rho*g*h$. Thus, the end plates may be urged against the end faces of the path-defining rollers by springs so shaped to ensure the desired location of the contact line between the end plates and the end faces of the rollers. Alternatively the elastomeric material covering of the path-defining rollers is somewhat oversized, the necessary spring force then being derived from the elasticity of the elastomeric material itself.

The fixed sealing member which is carried in, or formed as part of, the longitudinal bearing preferably exerts a pressure on the intermediate rollers which is also at least $\rho*g*h$, most preferably at least $2\rho*g*h$. To reduce friction at this point, the contact surface between the fixed sealing member and each intermediate roller is kept to a minimum. It is also desirable to establish a sealing pressure between the path-defining roller and the intermediate rollers. While this should preferably also exceed $\rho*g*h$ and most preferably 2 $\rho*g*h$, the absolute force applied by the path-defining roller to the intermediate rollers should be greater than the absolute force exerted by the fixed sealing member on the intermediate rollers to ensure that the intermediate rollers touches the bearing surfaces of the longitudinal bearing. This enables the absolute force exerted by the intermediate rollers on the bearing surfaces to be reduced to a minimum thereby reducing the friction at this point. The pressure exerted by the path-defining roller on the intermediate rollers may be derived from the mounting of the intermediate rollers or simply from compression of the elastomeric material covering of the associated path-defining roller or from spring forces exerted on the path-defining roller.

It is preferred that the end faces of the intermediate rollers and fixed sealing member extend beyond the end faces of the elastomeric part of the path-defining roller. In this way the sealing function is less dependant on tolerances and differential thermal expansion of these components and their thermal expansion relative to the path-defining roller, more precisely between the end faces of the path-defining roller. That is, it is preferred that the stationary sealing member is longer than the associated path-defining roller, and further that the contact surfaces of the longitudinal bearing with the intermediate rollers are shorter than the associated path-defining roller.

One or both of the path-defining rollers may constitute a drive roller for driving the sheet material along the sheet material path. Alternatively, the path-defining rollers may be freely rotating, alternative drive means being provided to drive the photographic sheet material through the apparatus.

The path-defining rollers may be biased together by a variety of methods, for example by making use of the intrinsic elasticity of the elastomeric material, by the use of fixed path-defining roller bearings. Alternatively, use may be made of resilient means such as springs which act on the ends of the path-defining roller shafts. The springs may be replaced by alternative equivalent compression means, such as e.g. a pneumatic or a hydraulic cylinder.

The apparatus may be of horizontal or vertical configuration. Each vessel of the apparatus according to the invention may be of modular construction and be provided with means to enable the vessel to be mounted directly beside, above or below an identical or similar other vessel. Alternatively, the apparatus may take an integral form or semi-integral form. By the term "semi-integral form" we intend to include an apparatus which is divided by a plane passing through all the vessels in the apparatus, particularly the plane of the sheet material path, enabling the apparatus to be opened-up for servicing purposes, in particular to enable easy access to the path-defining rollers.

The apparatus according to the invention may include a substantially closed connection between adjacent vessels.

Each vessel of the apparatus may comprise a housing part which is so shaped in relation to a housing part of the next adjacent vessel as to provide the substantially closed connection between the vessels. For example, housing wall parts may be provided with flanges, means being provided to secure the flange of one housing wall part with the flange of a housing wall part of the next adjacent vessel thereby to provide the substantially closed connection. Optionally, a gasket may be positioned between the vessels to improve the reliability of this connection.

The end-most liquid-containing vessel of the apparatus is preferably provided with closure means for reducing the evaporation, oxidation and carbonisation of treatment liquid therefrom (and any other undesirable exchange between the treatment liquid and the environment).

Part of the housing of each vessel is preferably so shaped as to define a leakage tray so positioned that any treatment liquid which passes, for example, through the path-defining roller nip drips from the path-defining rollers of that vessel and falls into the leakage tray, for collection and recirculation as desired.

One or more of the vessels of the apparatus may include additional features if desired. Cleaning means may be provided for acting upon the path-defining rollers to remove debris therefrom, as described in European patent application EP 0 647 882 (Agfa-Gevaert NV).

Additional path-defining rollers, such as a path-defining roller pair or staggered path-defining rollers may be provided for transporting the sheet material through the apparatus, and these path-defining rollers will normally be driven path-defining rollers. Additional roller pairs may be provided for breaking the laminar fluid at the surface of the sheet material as it passes through the apparatus, and these rollers may be driven rollers or freely rotating rollers. Spray means may be provided for applying treatment liquid to the sheet material. Guide means may be included for guiding the passage of the sheet material through the apparatus. Heating means may be provided in one or more vessels so that the vessel becomes a sheet material drying unit, rather than a wet treatment unit. While liquid pumping, heating, cooling and filtering facilities will normally be provided outside the vessels, it is possible for some elements of these features to be included in the vessels themselves. Any combination of these additional features is also possible.

In one embodiment of the invention, one or more of the vessels includes at least one passage through the housing thereof to constitute an inlet and/or outlet for treatment liquid into and/or from the associated vessel. One or more vessels may not contain processing liquid, these vessels providing a dead space where diffusion reactions can occur on the sheet material as it passes there-through.

DETAILED DESCRIPTION OF THE INVENTION

The invention will be described by the following illustrative embodiments with reference to the accompanying drawings without the intention to limit the invention thereto, and in which.

Figure 1:
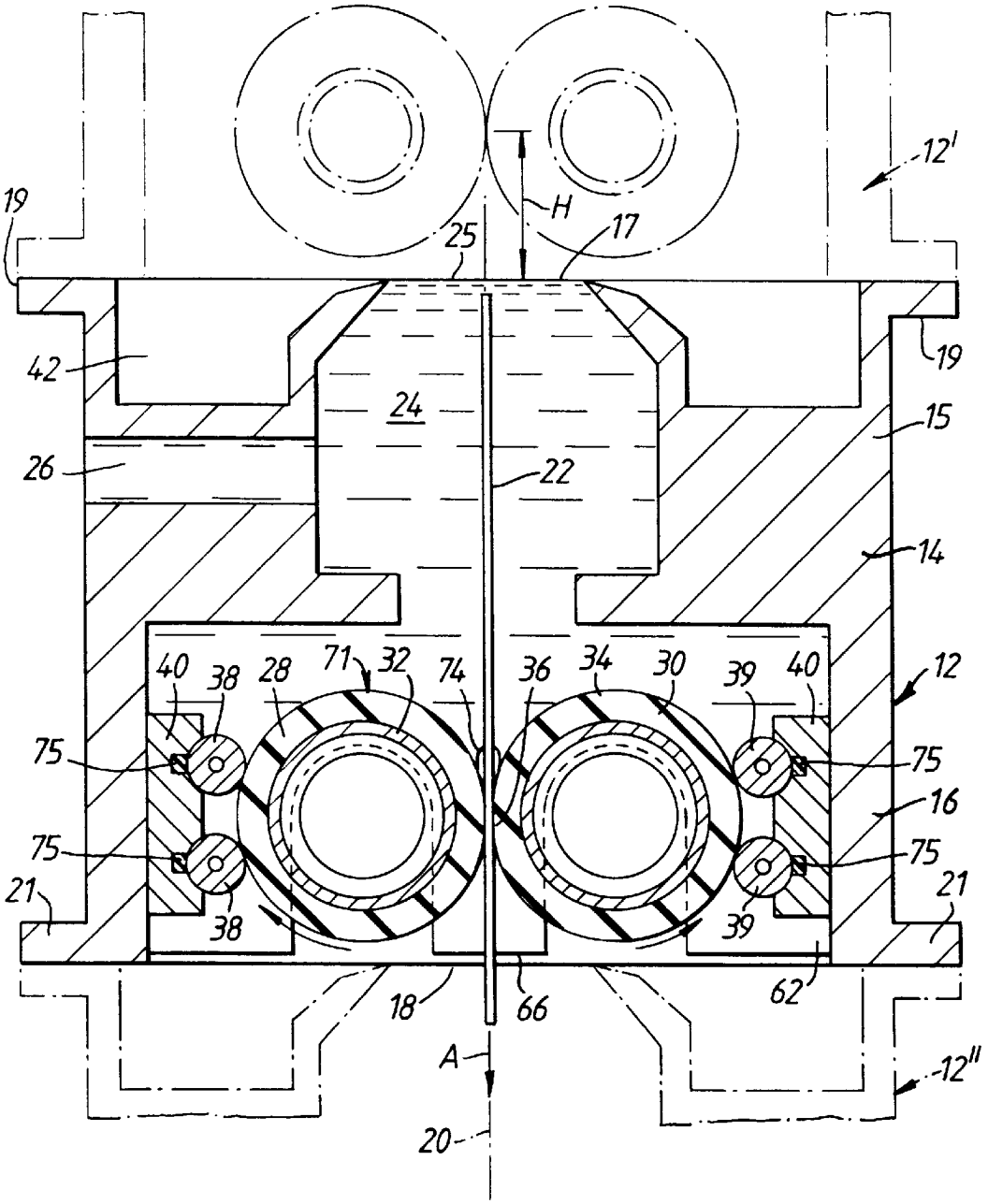
FIG. 1 is, in solid lines, a cross-sectional view of one vessel of a vertical processing apparatus according to the invention, with adjacent vessels being partly shown in broken lines.

Although only one specific embodiment of a treatment vessel according to the invention is shown in the FIGURES, the invention is not restricted thereto. The apparatus 10 for the wet processing of photographic sheet material such as X-ray film as shown in the FIGURES comprises a number of treatment vessels 12', 12, 12" mounted one above another. These vessels may be arranged to provide a sequence of steps in the processing of sheet photographic material, such as developing, fixing and rinsing. The vessels may be of a modular structure as shown or may be part of an integral apparatus.

Each treatment vessel, such as treatment vessel 12 comprises a housing 14 which is of generally rectangular cross-section and is so shaped as to provide an upper part 15 having an upper sheet material inlet opening 17 and a lower part 16 having a lower sheet material outlet opening 18 defining a sheet material path 20 through the vessel 12, the sheet material 22 moving in a downwards direction as indicated by the arrow A. Each vessel 12 may contain treatment liquid 24, a passage 26 in the housing 14 being provided as an inlet for the treatment liquid 24.

The opening 18 is closed by a pair of path-defining rotatable rollers 28, 30 biased towards each other. The line of contact between the path-defining rollers 28, 30 defines the nip 36 there-between through which the sheet material path 20 extends. The nip 36 has a length which extends beyond the limits of the lower opening 18. The sheet material preferably has a width which is at least 10 mm smaller than the length of the nip 36, so as to enable a spacing of at least 5 mm between the edges of the sheet and the adjacent limit of the nip, thereby to minimise leakage.

The path-defining rollers 28, 30 are coupled to drive means (not shown) so as to constitute drive rollers for driving the sheet material 22 along the sheet material path 20.

Each path-defining roller 28, 30 is in sealing contact along its length, with two rotatable intermediate rollers 38, 39 each formed for example of hardened or PTFE-coated metal carried by fixed longitudinal bearings 40, formed, for example, of high density polyethylene, mounted on the housing 14.

The upper and lower housing parts 15, 16 are provided with flanges 19, 21 respectively to enable the vessel 12 to be mounted directly above or below an identical or similar other vessel 12', 12", as partly indicated in broken lines in FIG. 1. The upper housing part 15 is so shaped in relation to the lower housing part 16 as to provide a substantially closed connection between adjacent vessels. Thus, treatment liquid from vessel 12 is prevented from falling into the lower vessel 12" by the path-defining rollers 28, 30 and intermediate rollers 38, 39, while vapours from the lower vessel 12" are prevented from entering the vessel 12 or escaping into the environment. This construction has the advantage that the treatment liquid in one vessel is not contaminated by contents of the adjacent vessels and that by virtue of the treatment liquids being in a closed system evaporation, oxidation and carbonisation thereof is significantly reduced.

The upper part 15 of the housing 14 is so shaped as to define a leakage tray 42. Any treatment liquid which may pass through the roller nip of the next higher vessel 12', in particular as the sheet material 22 passes therethrough, drips from the path-defining rollers of that vessel and falls into the leakage tray 42 from where it may be recovered and recirculated as desired. The distance H between the surface 25 of the liquid 24 and the nip of the path-defining rollers of the next upper vessel 12' is as low as possible.

Each path-defining roller 28, 30 is of the squeegee type comprising a stainless steel hollow core 32 carrying an elastomeric material covering 34. The core 32 is in cylindrical form having constant internal and external diameters along the length thereof. The path-defining rollers 28, 30 are of identical length biased towards each other with a force sufficient to effect a liquid tight seal but without causing damage to the photographic sheet material 22 as it passes there-between. The flexural E-modulus of the core 32 is preferably between 60 and 210 GPa, such as 350 GPa. The construction of path-defining roller 28 is shown in more detail in FIG. 2. The construction of path-defining roller 30 is similar. The roller 28 comprises a hollow core 32 of stainless steel, having a constant outside diameter of 25 mm and an internal diameter of 19 mm. The stainless steel core 32 has a flexural E-modulus of 210 GPa. The elastomeric covering 34 has a thickness varying from 7 mm and the roller ends to 7.5 mm at the roller centre. The path-defining roller 28 has a length of 750 mm and a maximum diameter of 40 mm. The maximum $\phi/L$ ratio is therefore approximately 0.053. The core 32 is welded to the boss 46 of a roller shaft 54 which extends axially out of the roller, the free end of the roller shaft 54 being retained in a bearing (not shown) or coupled to a drive wheel (not shown) to provide drive to the roller.

The elastomeric covering 34 comprises an inner layer 48 of EPDM rubber having a hardness of 30 Shore (A) and an outer layer 50 of EPDM rubber having a hardness of 50 Shore (A) positioned over the inner layer 48. The outer layer 50 of the elastomeric covering 34 is doped with PTFE as a surface modifying material.

The intermediate rollers 38, 39 constitute sealing means for sealing the path-defining rollers 38, 39 to the housing 14. The intermediate rollers 28, 30 each have a flexural E-modulus of 210 GPa. The intermediate rollers 38 and 39 contact the surface of the path-defining roller 28 at locations which are respectively 120° and 240° from the centre of the nip 36.

Figure 2:
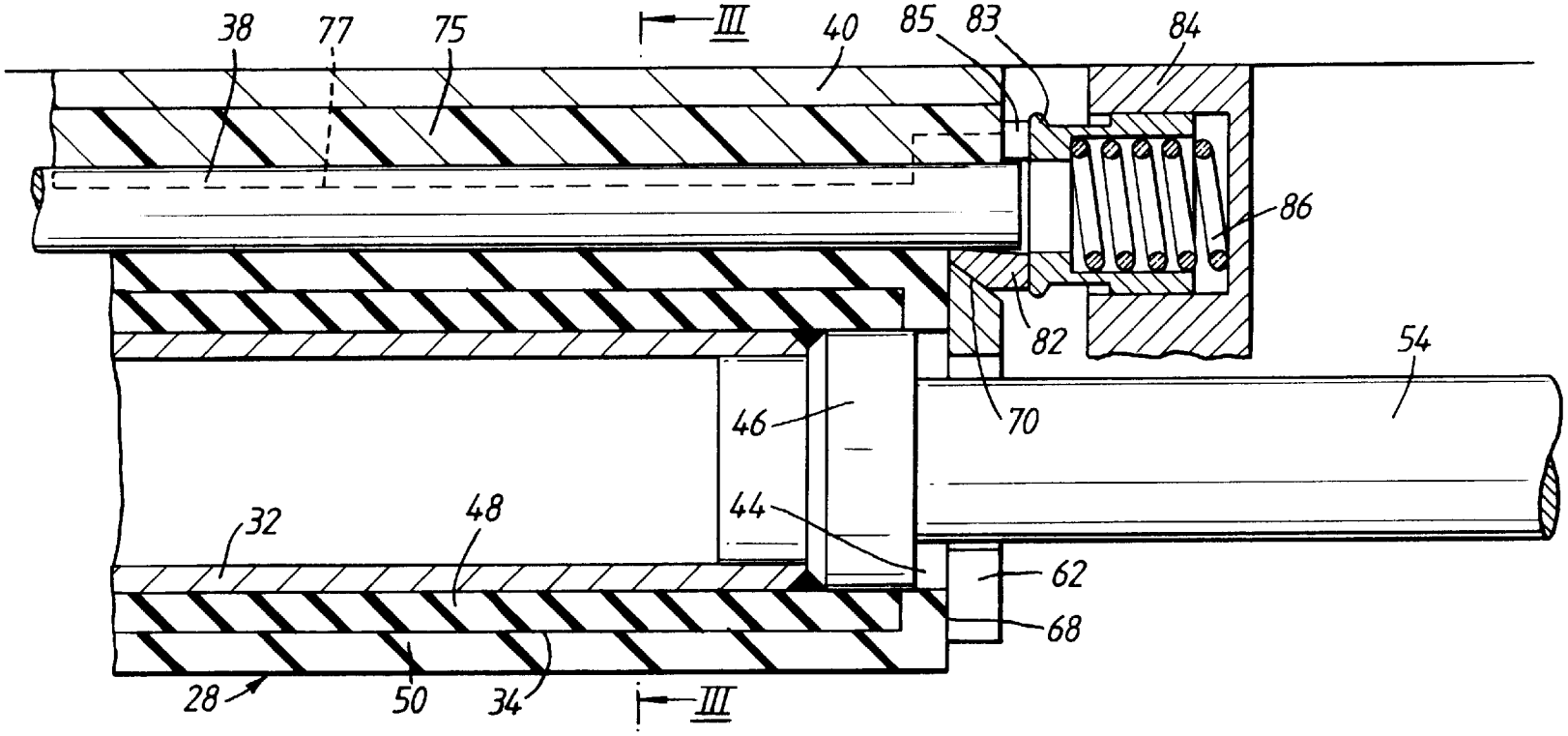
FIG. 2 is a longitudinal cross-sectional partial view showing the detail of the construction of one path-defining roller together with an associated intermediate roller and fixed sealing member used in the vessel shown in FIG. 1.

The path-defining roller 28 is in contact with each intermediate roller 38 along the length thereof. Each end of each intermediate roller 38 extends into an aperture 70 formed in an end plate 62 carried on the housing 14 of the apparatus. The aperture 70 is open-sided towards the top as viewed in FIG. 2. A sintered PTFE sealing ring 82 surrounds the end of the intermediate roller 38 in the aperture 70 and is urged into the aperture and into sealing engagement with the intermediate roller 38 by a metal plunger 83 loaded by a spring 86 carried in a body 84, fixed to the housing 14 of the apparatus. As shown in FIG. 2 the sealing ring 82 has a frusto-conically shaped inner surface, thereby establishing a line contact rather than a surface contact with the outer surface of the intermediate roller 38. The aperture 70 in the end plate is provided with a matching frusto-conical inner surface. Compensation for the wear of the sealing ring 82 is achieved by the provision of the spring force which acts in a direction to feed sealing material towards the wear surface.

The upper surface of the intermediate roller 38 is in contact with a fixed sealing member 75 in strip form, which is a pressure fit in the groove 81 of the longitudinal bearing 40 or alternatively is secured therein by means of a water- and chemical-proof adhesive, and extends lengthwise beyond the ends of the intermediate roller 38.

The intermediate roller 38 and the fixed sealing member 75 extend beyond the end face 68 of the covering 34 of the path-defining roller 28. In this way the sealing function is less dependant on tolerances and differential thermal expansion of these components and their thermal expansion relative to the path-defining roller, more precisely between the end faces of the path-defining roller. Further, the contact surfaces of the longitudinal bearing 40 with the intermediate roller 38, the lower edge of which is indicated by the broken line 77, are shorter than the path-defining roller 28.

The sealing member 75 is, for example, an extruded profile of Santoprene, an extrusion of various different grades of Santoprene or an extrusion of Santoprene with polypropylene. In all these cases, the Santoprene may be foamed or unfoamed. The Santoprene may be replaced by EPDM. The polypropylene may be replaced by polybutylterephthalate (PBT). A sealing member which is a co-extrusion of EPDM with PBT is also possible. Fillers may be included in the sealing material. The sealing member should have good chemical resistance and durability. The end of the sealing member 75 extends into a slot 85 formed in the PTFE sealing ring 82.

In an alternative embodiment, the sealing member 75 is co-extruded with the longitudinal bearing 40, especially if formed of polyethylene or polypropylene.

Figure 3:
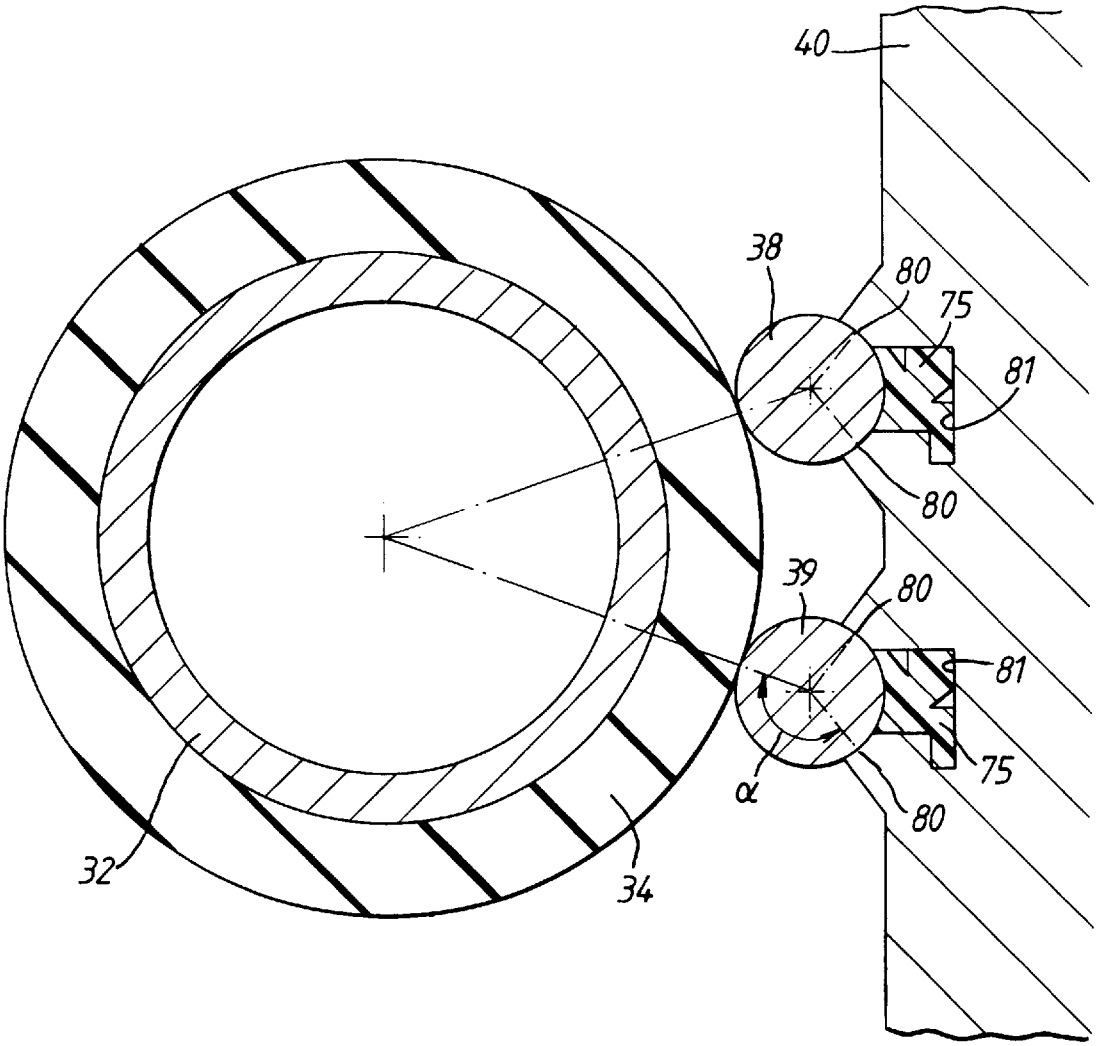
FIG. 3 is an enlarged cross-sectional view taken on the line IV—IV in FIG. 2

As can be seen in FIG. 3, the longitudinal bearing 40 is in face-to-face contact with the intermediate roller over two contact regions 80, which are positioned one on either side of a groove 81 extending along the length of the longitudinal bearing 40, the contact regions 80 being located at an average angle $\alpha$ of 135° relative to the line joining the centres of a path-defining roller 28 and the intermediate rollers 38.

The longitudinal bearing 40 is secured to the housing 14 of the vessel 12, the treatment liquid 24 being retained in the vessel 12 by the path-defining rollers 28, 30 and the intermediate rollers 38, 39.

Where the apparatus is designed to operate in the opposite direction, the active forces on the path-defining roller versus the nip may be modified to take account, in particular, of the consequential differences in the reaction forces of the intermediate rollers on the path-defining roller in such a way that the forces on the sheet material are kept constant.

The end face 68 of the outer layer of the covering 34 is in contact with an end plate 62. The covering 34 extends beyond the end of the core 32 to define a space 44 into which the elastomeric material of the covering 34 may be deformed as a result of a sealing force between the covering 34 and the intermediate roller 38 on the one hand and the end plate 62 on the other.

The path-defining rollers 28, 30 are positioned relative to each other such that end face 68 of the first roller 28 lies in the same plane as end face of the other roller 30. Each roller is in sealing contact, not only along its length with the respective intermediate rollers 38, 39 but also by its end faces with the end plate 62. The end plate 62 is so shaped as to have a lower edge 66 which follows a circumferential line around the shaft 54 of the first path-defining roller 28 and a circumferential line around the shaft of the second path-defining roller 30 to enable the end plate to be in face-to-face contact with the end face 68 of the first path-defining roller 28. At its lowest point, the edge 66 is below the level of the nip 36. The circumferential distance over which the end plate 62 is in contact with the end face 68 of the first path-defining roller 28 and the end face of the second path-defining roller 30 is as low as possible, but is larger than the circumferential distance between the nip 36 and the intermediate roller 38.

The end plate 62 includes an aperture 74, the lower edge of which is positioned below the level of the top of the rollers 28, 30, enabling the bulk of the treatment liquid 24 to flow out of the vessel at each end thereof and to be recirculated as desired.

The end plates 62 are urged against the end faces of the rollers 28, 30 by springs (not shown). A suitable spring force is from 2 to 500 g/cm of contact between the end plate 62 and the end face 68 of the roller 28 measured at the surface of the roller. The pressure between the end face 68 of the path-defining roller 28 and the end plate 62 is at least $2\rho*g*h$, which in the case where the height of the treatment liquid above the sealing point is 0.4 m means a pressure of at least 9408 Pa. When the path defining roller has a diameter ($\phi$) of 40 mm and the width of contact between the end plate and the end face of the roller is 2 mm over an angle of 90°, a force applied to the end plate of $$\pi\phi/4*0.02*9408 = 5.64 \text{ N } (45 \text{ g/cm})$$

is required to establish this pressure.

The intermediate rollers 38, 39 and the two end plates complete a continuous sealing path which, together with the roller nip 36 retains the treatment liquid 24 in the vessel 12.

| Reference Number List | |
|---|---|
| apparatus 10 | boss 46 |
| vessels 12', 12, 12" | inner layer 48 |
| housing 14 | outer layer 50 |
| upper part 15 | roller shaft 54 |
| lower housing part 16 | end plate 62 |
| inlet opening 17 | lower edge 66 |
| outlet opening 18 | end face 68 |
| flanges 19, 21 | aperture 70 |
| path 20 | surface 71 |
| sheet materia1 22 | aperture 74 |
| treatment liquid 24, | fixed sealing member 75 |
| surface 25 | broken line 77 |
| passage 26 | contact regions 80 |
| path-defining rollers 28, 30 | groove 81 |
| core 32 | sealing ring 82 |
| covering 34 | plunger 83 |
| nip 36 | body 84 |
| intermediate rollers 38, 39 | slot 85 |
| bearing 40 | spring 86 |
| leakage tray 42 | arrow A |
| space 44 | distance H |

What is claimed is:

1. An apparatus for the wet processing of photographic sheet material comprising at least one treatment vessel (12) comprising a housing (14) having a sheet material inlet opening (17) and a sheet material outlet opening (18) defining a sheet material path (20) through said vessel (12), said openings (17, 18) being closed by a path-defining rotatable roller (28) biased towards a reaction surface (30) to form a nip (36) there-between through which said sheet material path (20) extends, characterized in that said path-defining roller (28) is in contact along its length, with a plurality of rotatable intermediate rollers (38) carried in fixed bearings (40) mounted on said housing (14) and in that each said rotatable intermediate roller (38) contacts the surface of said path-defining roller (28) at a location that is between 45° and 315° from the center of said nip (36).

2. An apparatus according to claim 1, further comprising sealing means for sealing said path-defining roller (28) to said housing (14).

3. An apparatus according to claim 2, wherein said sealing means is constituted by said intermediate rollers (38).

4. An apparatus according to claim 1, wherein each said intermediate roller (38) has a diameter less than that of said path-defining roller (28).

5. An apparatus according to claim 1, wherein each said intermediate roller (38) is formed of a material having a coefficient of friction, as measured against stainless steel, of less than 0.3.

6. An apparatus according to claim 1 wherein said path-defining roller (28) comprises a core (32) carrying an elastomeric material covering (34).

7. An apparatus according to claim 6, wherein the flexural E-modulus of said core (32) is less than 300 GPa.

8. An apparatus according to claim 6, wherein said elastomeric material covering (34) has a maximum diameter (ϕ) and a length (L) so related that the ratio thereof (ϕ/L) is less than 0.012.

9. An apparatus according to claim 6, wherein said elastomeric covering (34) comprises an inner layer (48) of elastomeric material having a relatively low hardness, and an outer layer (50) of elastomeric material having a relatively high hardness positioned over said inner layer (48).

10. An apparatus according to claim 6, wherein an outer layer (50) of said elastomeric covering (34) is doped with a surface modifying material.

11. An apparatus according to claim 1, wherein said reaction surface is constituted by a further path-defining roller (30).

12. An apparatus for the wet processing of photographic sheet material comprising at least one treatment vessel (12) comprising a housing (14) having a sheet material inlet opening (17) and a sheet material outlet opening (18) defining a sheet material path (20) through said vessel (12), said openings (17, 18) being closed by a path-defining rotatable roller (28) biased towards a reaction surface (30) to form a nip (36) there-between through which said sheet material path (20) extends, characterized in that said path-defining roller (28) is in contact along its length, with a plurality of rotatable intermediate rollers (38) carried in fixed bearings (40) mounted on said housing (14) and in that each said rotatable intermediate roller (38) contacts the surface of said path-defining roller (28) at an average location which is between 45° and 315° from the center of said nip (36).

13. An apparatus according to claim 12, further comprising sealing means for sealing said path-defining roller (28) to said housing (14).

14. An apparatus according to claim 13, wherein said sealing means is constituted by said intermediate rollers (38).

15. An apparatus according to claim 12, wherein each said intermediate roller (38) has a diameter less than that of said path-defining roller (28).

16. An apparatus according to claim 12, wherein each said intermediate roller (38) is formed of a material having a coefficient of friction, as measured against stainless steel, of less than 0.3.

17. An apparatus according to claim 12 wherein said path-defining roller (28) comprises a core (32) carrying an elastomeric material covering (34).

18. An apparatus according to claim 17, wherein the flexural E-modulus of said core (32) is less than 300 GPa.

19. An apparatus according to claim 17, wherein said elastomeric material covering (34) has a maximum diameter (ϕ) and a length (L) so related that the ratio thereof (ϕ/L) less that 0.012.

20. An apparatus according to claim 17, wherein said elastomeric covering (34) comprises an inner layer (48) of elastomeric material having a relatively low hardness, and an outer layer (50) of elastomeric material having a relatively high hardness positioned over said inner layer (48).

21. An apparatus according to claim 17, wherein an outer layer (50) of said elastomeric covering (34) is doped with a surface modifying material.

22. An apparatus according to claim 12, wherein said reaction surface is constituted by a further path-defining roller (30).

* * * * *